US005442430A

United States Patent [19]

Ishii et al.

[11] Patent Number: 5,442,430

[45] Date of Patent: Aug. 15, 1995

[54] COLOR IMAGE FORMING APPARATUS AND CLEANING DEVICE THEREFOR

[75] Inventors: Yoshiko Ishii, Tokyo; Shigeru Yoshiki, Kawasaki; Tsukuru Kai, Fujisawa, all of Japan

[73] Assignee: Ricoh Company, Ltd., Tokyo, Japan

[21] Appl. No.: 261,327

[22] Filed: Jun. 16, 1994

[30] Foreign Application Priority Data

| | | | |
|---|---|---|---|
| Jun. 16, 1993 | [JP] | Japan | 5-145026 |
| Jul. 3, 1993 | [JP] | Japan | 5-190919 |
| Dec. 28, 1993 | [JP] | Japan | 5-337405 |

[51] Int. Cl.[6] ..... G03G 21/10

[52] U.S. Cl. ..... 355/298; 355/326 R; 355/300; 355/301; 118/652

[58] Field of Search ..... 355/298, 300, 296, 297, 355/326 R, 327, 299, 301; 118/652

[56] References Cited

U.S. PATENT DOCUMENTS

| | | | |
|---|---|---|---|
| 4,894,688 | 1/1990 | Taniguchi et al. | 355/298 |
| 5,036,369 | 7/1991 | Toda et al. | 355/298 |
| 5,081,505 | 1/1992 | Ziegelmuller et al. | 355/299 |
| 5,264,904 | 11/1993 | Audi et al. | 355/299 |
| 5,272,510 | 12/1993 | Reese | 355/298 |
| 5,289,241 | 2/1994 | Sugiyama et al. | 355/260 |

*Primary Examiner*—R. L. Moses

*Attorney, Agent, or Firm*—Oblon, Spivak, McClelland, Maier & Neustadt

[57] ABSTRACT

A color image forming apparatus and a cleaning device therefor are disclosed. Toner of different colors left on a photoconductive element image transfer are sequentially collected by respective cleaning units. A recycling mechanism, including conveyor screws, returns the collected toners from the cleaning units to corresponding developing units for reuse.

19 Claims, 14 Drawing Sheets

COLOR IMAGE FORMING APPARATUS AND CLEANING DEVICE THEREFOR

BACKGROUND OF THE INVENTION

The present invention relates to a color copier, color printer or similar color image forming apparatus, and a cleaning device for cleaning an image carrier included in the image forming apparatus.

It is a common practice with a color image forming apparatus to form toner images of different colors on a photoconductive element by an electrophotographic procedure, and sequentially transfer them to a paper or similar recording medium one above the other, thereby completing a multicolor or full-color image. In this type of apparatus, every time a toner image of any color is transferred from the drum to the paper, a cleaning device cleans the surface of the drum to prepare it for the next toner image.

There has been proposed a cleaning device constructed to recycle the toners collected from the drum to a developing device. This kind of implementation elaborated to reduce the running cost of the image forming apparatus. However, the conventional cleaning device with such a capability is provided with only one cleaning unit. This brings about a problem that the toners of different colors removed from the drum are collected in the same cleaning unit and, therefore, mixed together. The collected toners, therefore, cannot be recycled or reused. To collect the toners of different colors individually, a plurality of cleaning units each being assigned to a particular toner may be arranged around the drum. This, however, requires a substantial space around the drum. The multiple cleaning unit scheme would, therefore, increase the overall size of the image forming apparatus and obstruct the free layout of process units around the drum.

SUMMARY OF THE INVENTION

It is, therefore, an object of the present invention to provide a a color image forming apparatus which allows each of the toners of different colors to be recycled independently of the others, and a cleaning device therefor.

It is another object of the present invention to provide a color image forming apparatus which reduces the space for the installation of cleaning units around an image carrier, and a cleaning device therefor.

In a color image forming apparatus having an image forming device of the type forming a toner image on an image carrier by using toners of at least two colors, a cleaning device of the present invention comprises a plurality of cleaning units each being assigned to the respective toner to be deposited on the image carrier, and a recycling mechanism for recycling the toners removed from the image carrier by the respective cleaning units.

Also, in accordance with the present invention, a color image forming apparatus comprises an image carrier, a developing device comprising a plurality of developing units each of which develops a latent image formed on the image carrier with a toner of particular color to thereby produce a corresponding toner image, a transfer unit for transferring the toner image to a recording medium, and a cleaning device for cleaning the toner remaining on the image carrier after image transfer. The cleaning device comprises a plurality of cleaning units adjoining each other in a circumferential direction. The cleaning units are each assigned to the toner of particular color. The cleaning device is revolvable such that in the event of cleaning, the cleaning units are selectively brought to a predetermined cleaning position.

BRIEF DESCRIPTION OF THE DRAWINGS

The above and other objects, features and advantages of the present invention will become more apparent from the following detailed description taken with the accompanying drawings in which.

In the figures, the same or similar constituent parts are designated by the same reference numerals.

DESCRIPTION OF THE PREFERRED EMBODIMENTS

Figure 1:
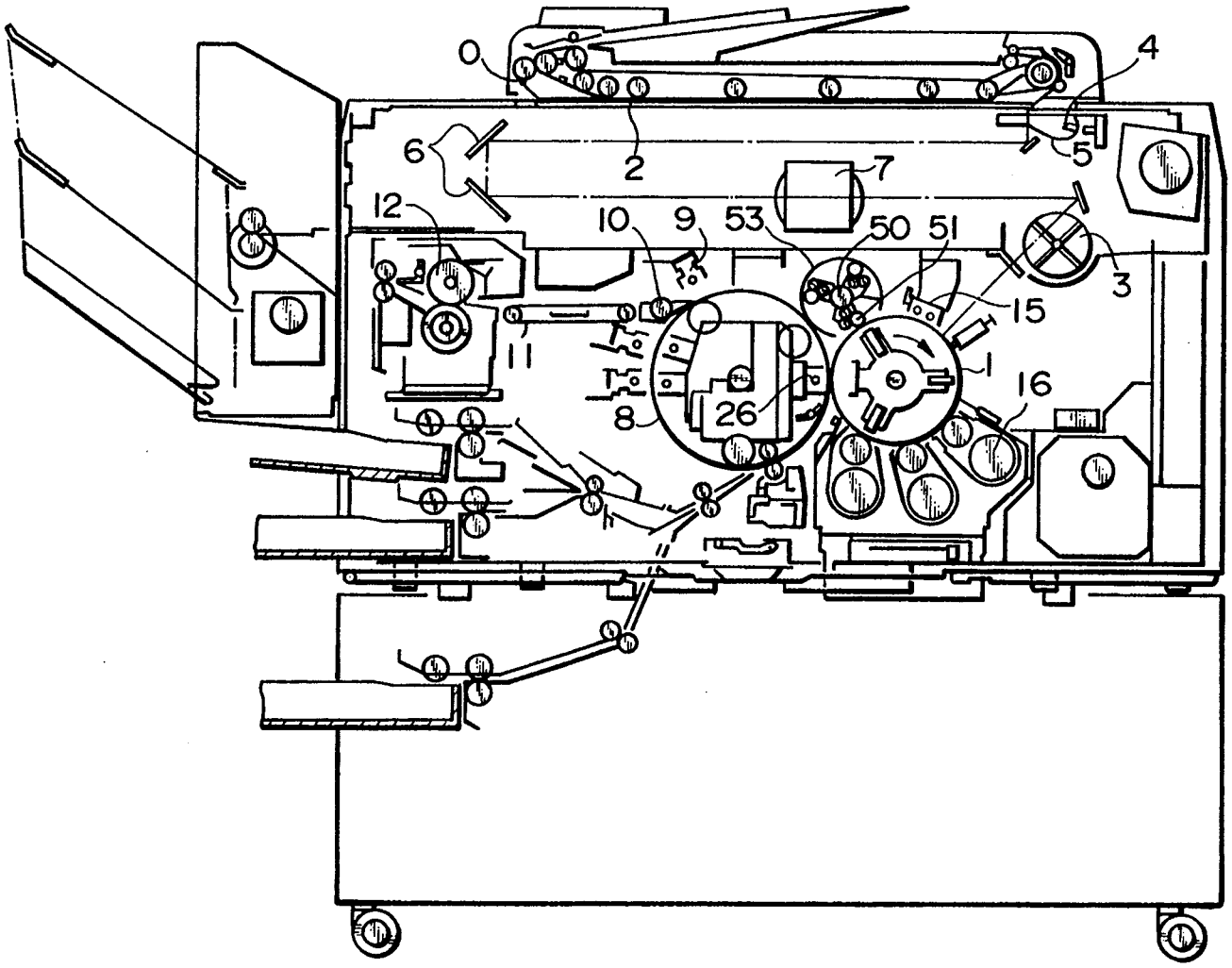
FIG. 1 is a section of a color image forming apparatus to which a cleaning device embodying the present invention is applied.

Referring to FIG. 1 of the drawings, an analog full-color copier is shown to which a cleaning device embodying the present invention is applied. Briefly, the copier reads a document image by separating it into three colors, forms color-separated images (toner images) on a single photoconductive element by sequentially switching color filters, and transfers the images of respective colors one above the other to a paper wrapped around a transfer drum. As a result, the toner images of three colors are laid one upon the other to complete a full-color image on the paper.

As shown in FIG. 1, the copier has a photoconductive drum 1 rotatable in a direction indicated by an arrow in the figure. The drum 1 may be implemented by an organic photoconductor (OPC). An original document O is laid on a glass platen 2. When a print switch, not shown, provided on the copier is pressed, the document O is scanned. At this instant, the surface of the drum 1 has been uniformly charged by a main charger 15. Specifically, light issuing from a lamp 4 is incident to the document O via a reflector 5. The resulting reflection from the document O is routed through mirrors 6 and a lens 7 to a red (R), green (G) and blue (B) color filter assembly 3. The filter assembly 3 separates the incident light, which is representative of the density distribution of the document O, into an R, G and B color components. As each of the R, G and B color components reaches the drum 1, it dissipates the charge from the portion of the drum 1 where it is incident. As a result, a cyan (C), magenta (M) or yellow (Y) latent image complementary to R, G or B is electrostatically formed on the drum 1. One of developing units 16 matching the R, G or B color filter 3 used is operated to develop the latent image, thereby producing a corresponding toner image. Specifically, the latent image is developed by a C toner when the R filter is used, by an M toner when the G filter is used, or by a Y toner when the B filter is used.

After a paper has been wrapped around a transfer drum 8, a transfer charger 26 transfers the toner image from the drum 1 to the paper. Specifically, at the beginning of a copying cycle, i.e., when the print switch is pressed, a single paper is fed from a paper feed section and wrapped around the transfer drum 8. Negative corona discharge is generated at the inside of the transfer drum 8, so that the resulting charge transfers the toner from the drum 1 to the paper. The current for image transfer is sequentially increased in the order of C, M and Y since such toner images are sequentially transferred one above the other.

Figure 2:
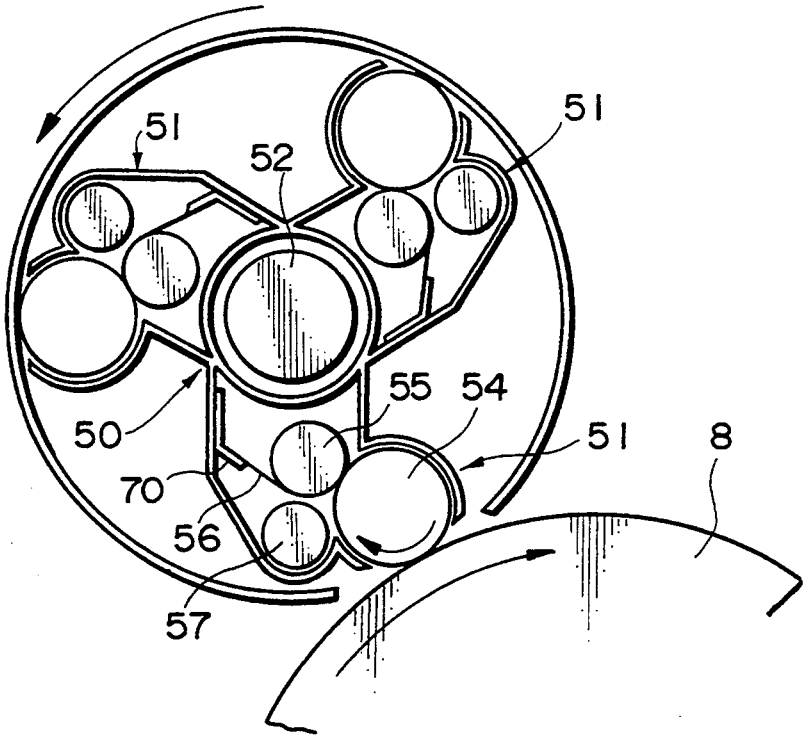
FIG. 2 is a section showing cleaning units included in the cleaning device of FIG. 1.

The toner remaining on the drum 1 after image transfer is collected by one of cleaning units 51 which constitute a cleaning device embodying the present invention. As shown in FIG. 2, in the illustrative embodiment, the cleaning units 51 assigned to the C, M and Y toners, respectively, are mounted on a single revolver 50. The revolver 50 is rotatable to bring one of the cleaning units 51 matching the color for exposure to a cleaning position which adjoins the drum 1.

The procedure described above is repeated three times while sequentially switching the color filters 3 and cleaning units 51. Consequently, a C, M and Y composite toner image, or full-color image, is formed on the paper wrapped around the transfer drum 8. The paper carrying the full-color image is separated from the transfer drum 8 by a separation charger 9 and a separator 10 and then conveyed by a belt 11 to a pair of fixing rollers 12. After the toner image on the paper has been fixed by the rollers 12, the paper is driven out of the copier to a tray.

Motors, not shown, are mounted on the revolver 50, and each drives one of the cleaning units 51. Specifically, each motor causes a fur brush 54 to rotate in a direction indicated by an arrow in FIG. 2, thereby collecting the toner remaining on the drum 1. A bias roller 55 removes the toner from the fur brush 54. Further, a scraper 56 scrapes off the toner from the bias roller 55. A particular voltage is applied to each of the bur brush 54 and bias roller 55. A higher voltage is applied to the bias roller 55 than to the fur brush 54 in order to facilitate the toner collection.

Figure 3:
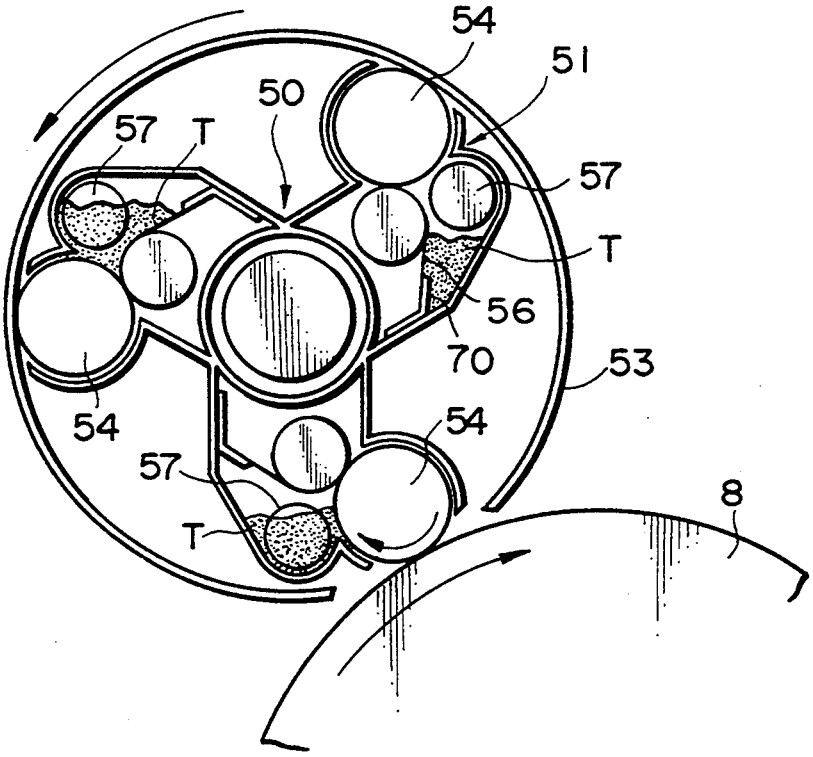
FIG. 3 is a section representative of the operation of the cleaning units.

A check wall 70 is positioned in an inner upper portion of each cleaning unit 51 to prevent the collected toner from flowing backward. As shown in FIG. 3, the check wall 70 and scraper 56 cooperate to stop the collected toner, labeled T, which moves in association with the rotation of the revolver 50. This prevents the toner T from flowing upstream with respect to the rotation of the fur brush 54; otherwise, the toner T would be scattered around out of the cleaning unit 51.

Figure 4:
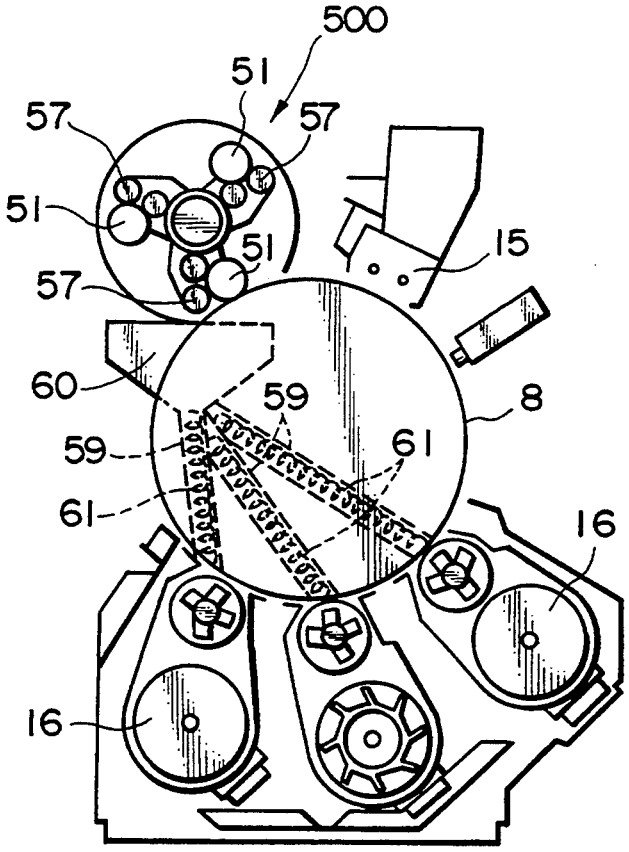
FIG. 4 is a section showing a conduitwork extending from the cleaning device to a developing device also included in the apparatus.
Figure 5:
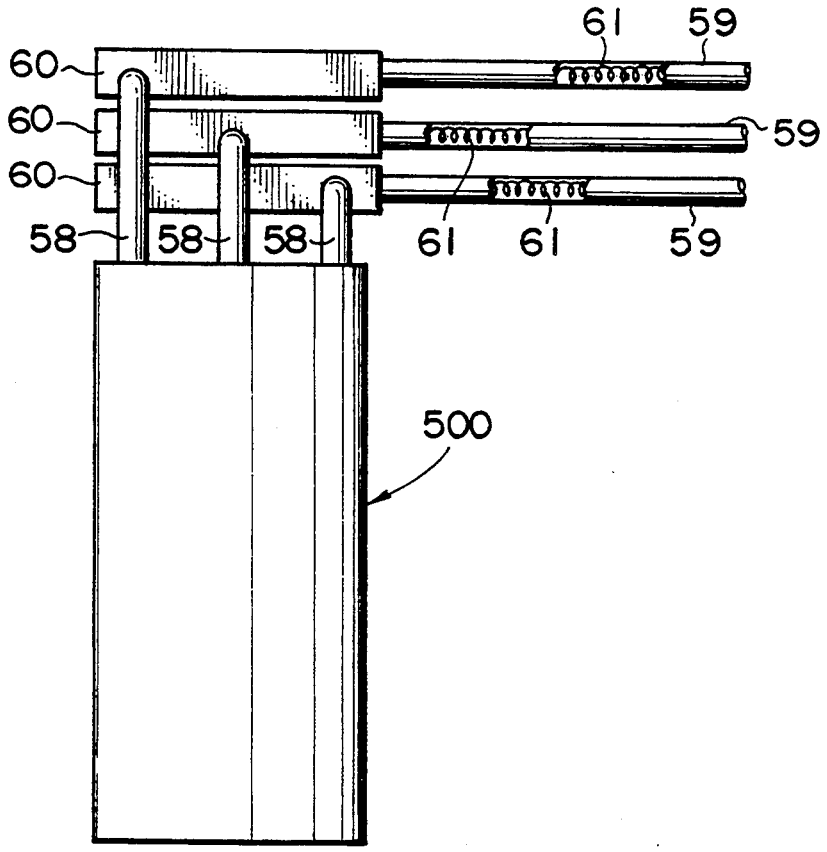
FIG. 5 is a plan view associated with FIG. 4.

As shown in FIGS. 4 and 5, a conveyor screw 57 is disposed in each cleaning unit 51 and conveys the toner T collected in the unit 51 deeper into the cleaning device, generally 500, (upward as viewed in FIG. 5). Then, the toner is driven out to a respective piping 59 via a piping 58 and a joint 60. The outlets of the pipings 58 are located at different positions from each other, so that the toners of different colors are introduced into the respective pipings 59. A conveyor screw 61 is disposed in each piping 59 and returns the collected toner T to associated one of the developing units 16 (FIG. 4).

The cleaning units 51 of the revolver 50 are respectively assigned to three colors C, M and Y. As shown in FIG. 2, the revolver 50 is rotatable about a shaft 52 in such a direction that the portion of each cleaning unit 51 facing the drum 1 is directed upward. In the illustrative embodiment, the cleaning units 51 are so arranged as to sequentially collect the toners of respective colors, i.e., according to the order of image forming processes using the respective toners. Hence, the revolver 50 should only be moved such that the cleaning unit 51 at the cleaning position is replaced with the adjoining cleaning unit 51. This minimizes the movement required of the revolver 50.

As shown in FIG. 1, the revolver 50 is surrounded by a stationary cover 53. When the collected toner T flows out of any of the cleaning units 51 by accident, the cover 53 prevents it from being scattered around in the copier.

Assume that an image forming process using any one of the toners of different colors is completed. Then, the fur brush 54 of the cleaning unit 51 is continuously rotated, and the bias voltage to the brush 54 is continuously applied. Assume that the cleaning unit 51 has fully cleaned the drum 1, i.e., the portion of the drum 1 where a latent image had been fully developed by associated one of the developing units 16 has moved away from the cleaning unit 51. Then, the revolver 50 starts rotating to replace the cleaning unit 51 with the next cleaning unit 51. While the revolver 50 is in rotation, the bias voltage to the fur brush 54 is continuously applied in order to prevent the toner from being left on the drum 1. As soon as the cleaning unit 51 assigned to the next toner arrives at the cleaning position, the revolver 50 stops rotating. In this condition, a latent image is developed by the next toner.

Figure 6:
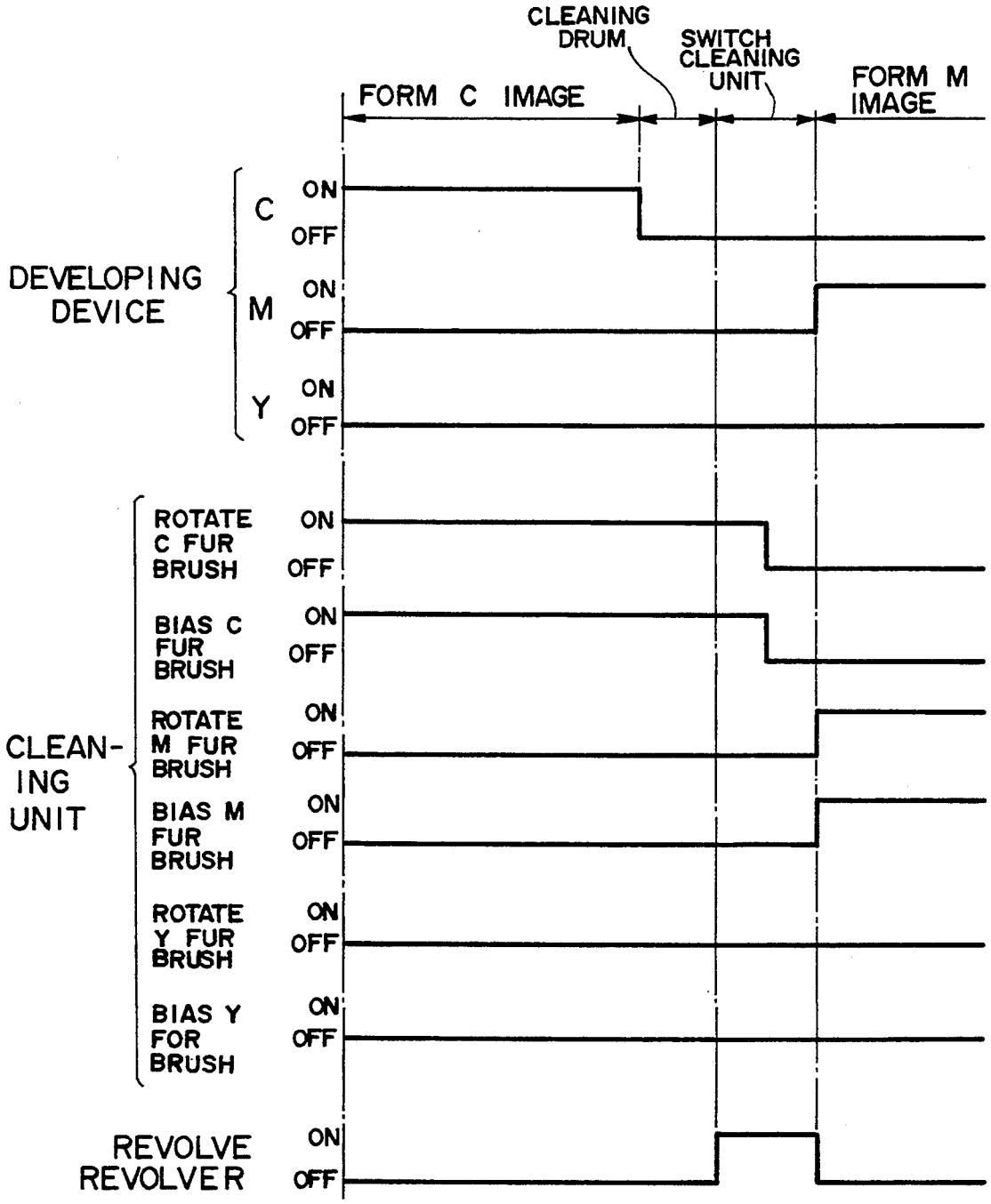
FIG. 6 is a timing chart demonstrating specific operations of the developing device and cleaning units to occur during image formation.

FIG. 6 is a timing chart demonstrating specific operations of the developing units 16 and cleaning units 51.

Figure 7:
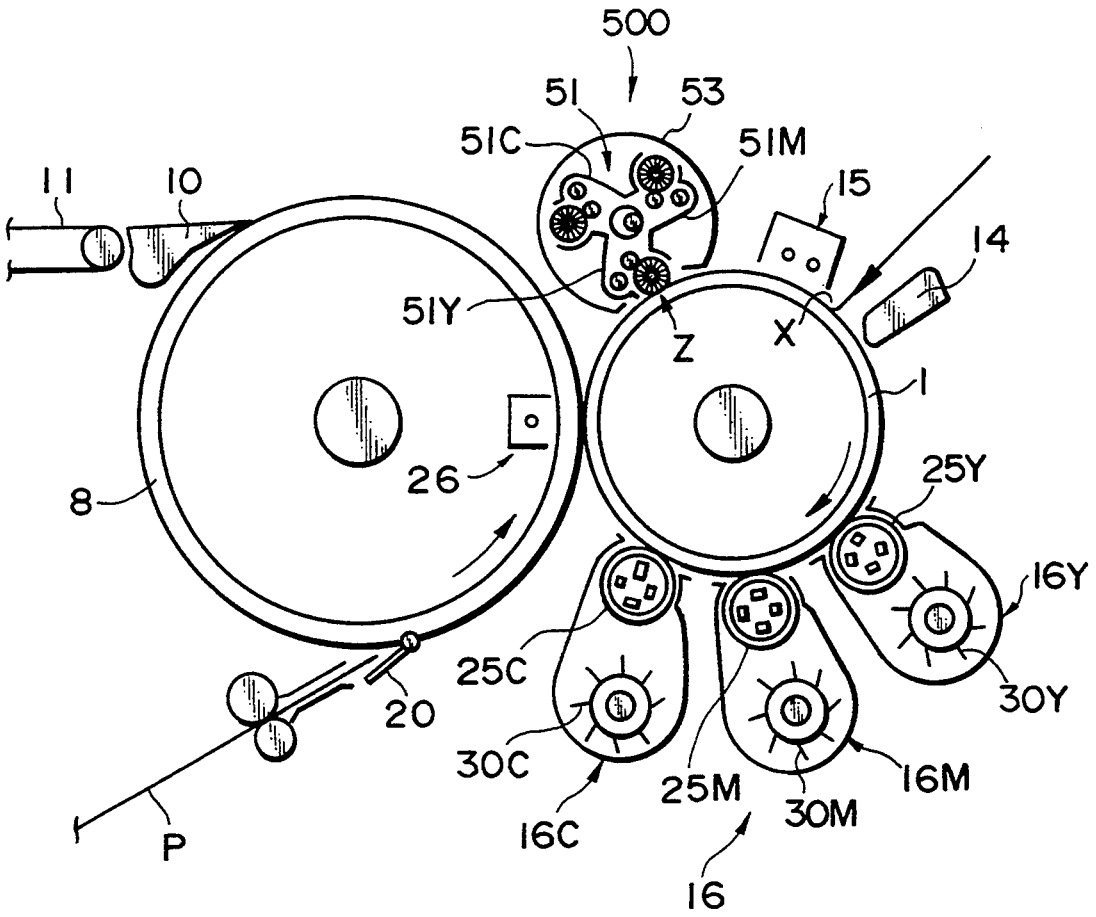
FIG. 7 a fragmentary section showing a preferred embodiment of the color image forming apparatus in accordance with the present invention.

Referring to FIG. 7, a color image forming apparatus embodying the present invention will be described. As shown, the apparatus has a photoconductive element, or image carrier, 1 rotatable in a direction indicated by an arrow in the figure. Arranged around the drum 1 are a main charger 15, an eraser 14, and a developing device made up of a plurality of developing units. In the illustrative embodiments, the developing device has a Y developing unit 16Y, an M developing unit 16M and a C developing unit 16C which are arranged side by side. A transfer drum 8 adjoins the drum 1 and has a clamper 20 thereon. A plain paper or similar recording medium P is wrapped around the transfer drum 8 by having the leading edge thereof retained by the clamper 20.

While the drum 1 is in rotation, a main charger 15 uniformly charges the surface of the drum 1 to a predetermined polarity. Subsequently, the eraser 14 dissipates the charge from the non-image area of the drum 1. Then, the charged area of the drum I is exposed imagewise at an exposing position X with the result that the first latent image is formed on the drum 1. The latent image is developed by the first developing unit, e.g., developing unit 16Y storing a Y toner. The resulting Y toner image is transferred to the paper P on the transfer drum 8 by a transfer charger 26. After the image transfer, the toner remaining on the drum 1 is removed by a cleaning device 500, as will be described later. Subsequently, charges remaining on the drum 1 are dissipated by a discharger, not shown.

Subsequently, the second latent image is formed on the drum 1 and then developed by the second developing unit, e.g., M developing unit 16M in exactly the same manner as the first latent image. The resulting M toner image is transferred to the paper P over the Y toner image previously transferred to the paper P. Then, the drum 1 is cleaned by the cleaning device 500 and the discharged by the discharger. Such a procedure is also repeated with the third latent image by the C developing unit 16C. As a result, a C toner image is transferred to the paper P over the M toner image. In this manner, the toner images of three colors are sequentially transferred to the paper P one above the other, completing a full-color image. The paper P carrying the full-color image thereon is separated from the transfer drum 8 by a separator 10 and then conveyed to a fixing device by a conveyor belt 11. The fixing device fixes the composite toner image on the paper P.

As stated above, the developing units 16Y, 16M and 16C each develops a latent image formed on the drum 1 with a toner of particular color. The toners stored in the developing units 16Y, 16M and 16C may each be implemented by a developer made up of a toner and carrier or a developer comprised of a toner only. The transfer charger 26 is a specific form of means for transferring the toner image from the drum 1 to the paper P.

Figure 8:
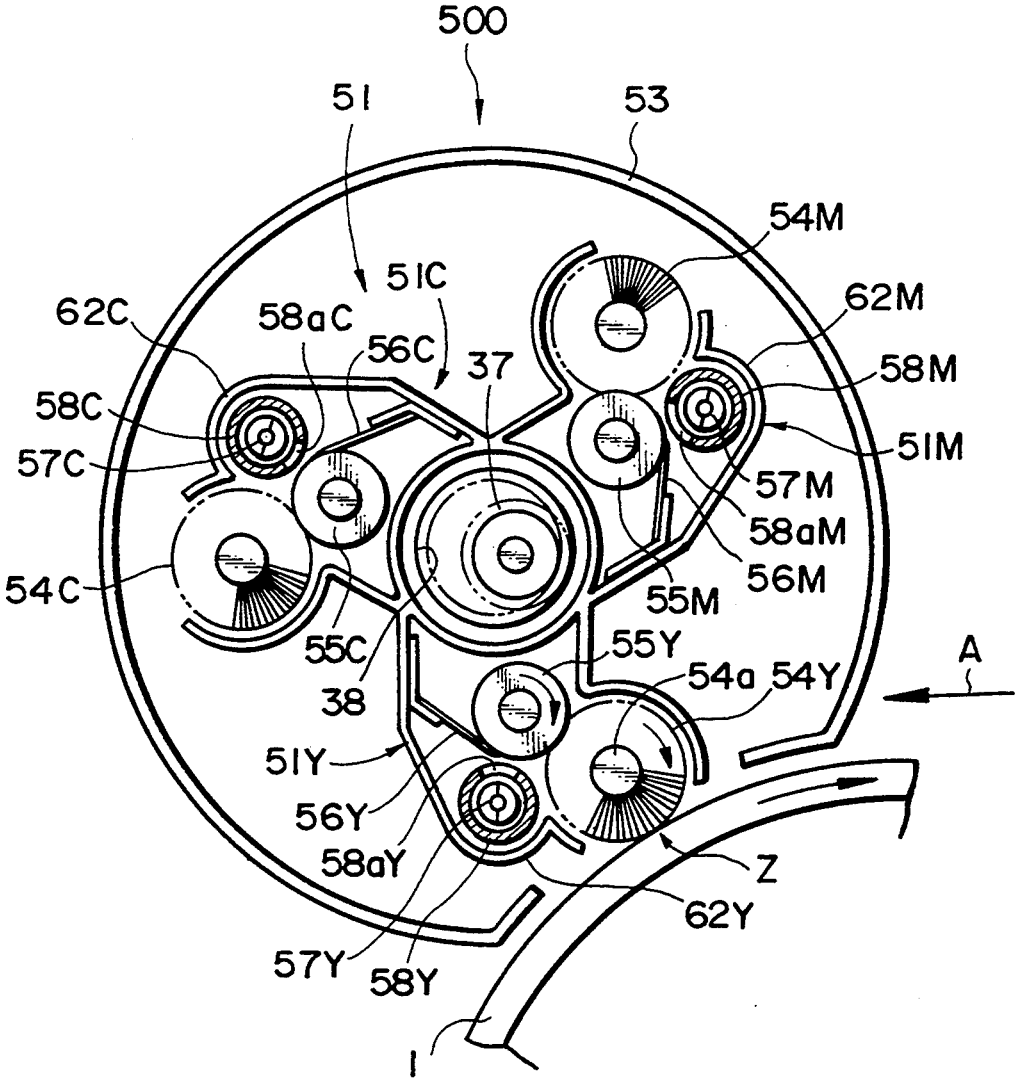
FIG. 8 is a section showing a cleaning device included in the embodiment of FIG. 7 in detail.

The cleaning device 500 faces the drum 1 and removes the toner remaining on the drum 1 after image transfer, as stated early. As shown in FIG. 8 in an enlarged scale, the cleaning device 500 has a plurality of cleaning units 51 adjoining each other in the circumferential direction. In the illustrative embodiment, the cleaning device 500 has a Y cleaning unit 51Y, an M cleaning unit 51M, and a C cleaning unit 51C. The cleaning units 51Y, 51M and 51C respectively remove the Y toner, M toner and C toner which are left on the drum 1 after image transfer.

As shown in FIG. 8, the cleaning units 51Y, 51M and 51C have substantially the same structure and arranged symmetrically about the axis of the cleaning device 500. Hence, let the following description concentrate on the Y cleaning unit 51Y by way of example. In the other cleaning units 51M and 51C, the same constituent parts as those of the cleaning unit 51Y are designated by the same reference numerals except for the suffixes.

The cleaning unit 51Y has a fur brush 54Y, a bias roller 55Y, a scraper 56Y, a conveyor screw 57Y, a piping 58Y, and a casing 62. In the specific condition shown in FIG. 8, the cleaning unit 51Y is located at a cleaning position Z where it faces the drum 1. In such a condition, the fur brush 54Y is rotated in a direction indicated by an arrow in the figure, while rubbing against the drum 1. The fur brush 54Y in rotation removes the Y toner left on the drum 1 without contributing to image transfer. The bias roller 55Y is rotated in a direction indicated by an arrow in the figure, while rubbing against the fur brush 54Y. As a result, the Y toner deposited on the fur brush 54Y is electrostatically transferred to the bias roller 55Y. The scraper 56Y scrapes off the Y toner from the bias roller 55Y. The scraped Y toner is introduced into the piping 58Y via an opening **58*a*Y and then conveyed along the piping 58Y by the conveyor screw 57. While the Y toner conveyed along the piping 58Y may be discharged to a predetermined receptacle, not shown, the embodiment causes toner delivering means, which will be described, to recycle the Y toner to the Y developing unit 16Y, FIG. 7**.

While the Y developing unit 16Y, FIG. 7, is in operation, the Y cleaning unit 51Y located at the cleaning position Z is operated in synchronism with the developing unit 16Y so as to remove the Y toner from the drum 1. As the cleaning unit 51Y completes the cleaning operation, the cleaning device 500 is bodily rotated 120 degrees clockwise by revolving means which will be described. As a result, the M cleaning unit 51M, i.e., fur brush 54M thereof is brought to the cleaning position Z. In this condition, the cleaning unit 51M collects the M toner from the drum 1 in the same manner as the cleaning unit 51Y. Then, the M toner is returned to the M developing unit 16M, FIG. 1, or may be discharged to a receptacle, if desired. As this cleaning step ends, the cleaning device 500 revolves another 120 degrees clockwise to bring the C cleaning unit 51C to the cleaning position Z. The cleaning unit 51C collects the C toner from the drum 1. The C toner is returned from the cleaning unit 51C to the C developing unit 16C, FIG. 1, or may be discharged to a receptacle, if desired.

As stated above, the cleaning units 51Y, 51M and 51C of the embodiment each removes a toner of corresponding color from the drum 1. The cleaning device 500 revolves such that the cleaning units 51 are selectively brought to the cleaning position Z.

Assume that the toners collected by the respective cleaning units 51Y, 51M and 51C are discharged without being returned to the associated developing units 16Y, 16M and 16C. Then, all the toners may be discharged to a single receptacle or may each be collected in a different receptacle. When a particular receptacle is assigned to each toner, it is possible to pour the toners to the associated developing units by hand.

A plurality of independent cleaning units may be arranged around a photoconductive drum and discharge collected toners to respective receptacles or return them to associated developing units. However, this is not practicable without resorting to an extra space and, therefore, increasing the overall size of the apparatus body. Moreover, such a scheme would limit the layout of various process units around the photoconductive drum.

The embodiment implements a single cleaning device for collecting the toners in respective receptacles or recycling them to associated developing units. This is successful in further miniaturizing a color image forming apparatus and enhancing the tree layout of process units.

Figure 9A:
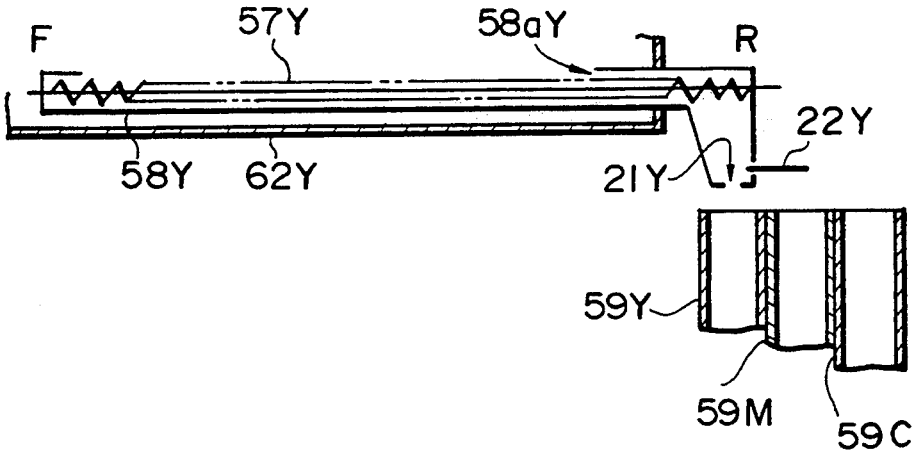
FIGS. 9A–9C are sectional side elevations showing a conduitwork included in the cleaning device of FIG. 8.
Figure 9B:
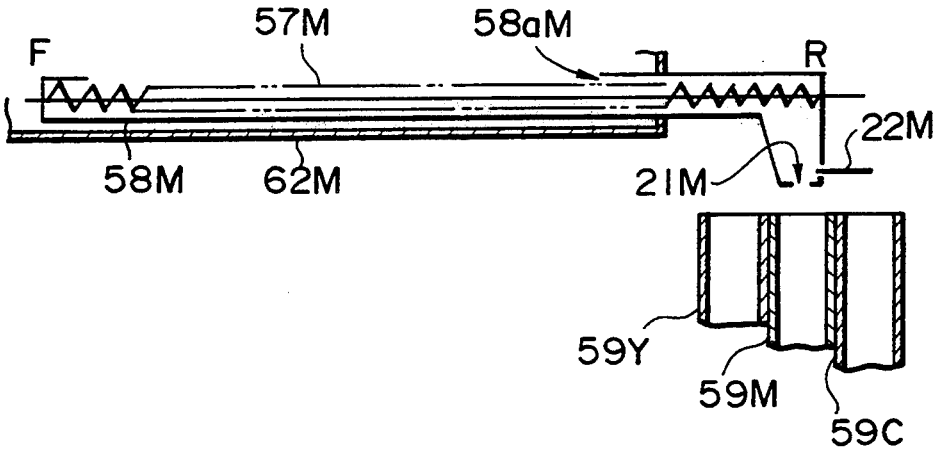
Figure 9C:
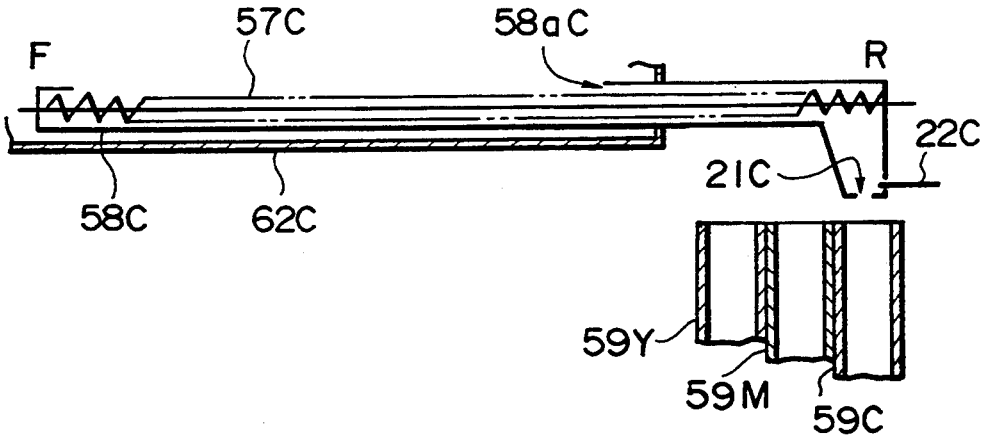

The embodiment includes toner delivering means for transporting the toners collected by the cleaning units 51Y, 51M and 51C to the developing units 16Y. 16M and 16C, respectively, as mentioned earlier. As shown in FIGS. 9A–9C, the pipings 58Y, 58M and 58C associated with the cleaning units 51Y, 51M and 51C, respectively, each has a particular length in the axial direction of the drum 1. Specifically, the piping 58M is longer than the piping 58Y while the piping 58C is longer than the piping 58M. This is also true with the relation in length between the conveyor screws 57Y–57C. FIG. 9A is a view of the piping 58Y and associated members as seen in a direction A shown in FIG. 8. In FIG. 7, the viewer's side is assumed to be the front side and is labeled F in FIGS. 9A–9C; the rear side is labeled R for distinction.

The pipings 58Y–58C are each hook-shaped at the rear end thereof and formed with an opening or toner outlet 21Y, 21M or 21C. The pipings 58Y–58C each has a particular length, as mentioned previously, so that the openings 21Y–21C are different in position in the axial direction of the drum 1.

While the cleaning unit 51Y is in operation, the conveyor screw 57Y shown in FIG. 9A is rotated. In this condition, the Y toner removed from the bias roller 55 and introduced into the piping 58Y via the opening **58*a* is conveyed from the front (F) to the rear (R) by the conveyor screw 57Y and dropped via the toner outlet 21Y. At this instant, a shutter 22Y is held in the rightmost position in FIG. 9A, unblocking the toner outlet 21Y**.

Pipings 59Y, 59M and 59C are made of for example, a flexible material and have their upper end portions arranged side by side at the rear side of the cleaning device 500. The other ends of the pipings 59Y–59C are respectively communicated to the developing units 16Y–16C, FIG. 1.

In FIG. 9A, the Y toner dropped via the toner outlet 21Y enters the piping 59Y, which precedes the pipings 59M and 59C, and returns to the developing unit 16Y to be reused thereby.

Assume that the cleaning unit 51M, FIG. 8, is located at the cleaning position Z. Then, as shown in FIG. 9B, the toner outlet 21M of the piping 58 is aligned with the intermediate piping 59M. In this condition, the M toner conveyed by the conveyor screw 57M is introduced into the piping 59M via the outlet 21M and returned to the developing unit 16M, FIG. 1. On the other hand, when the cleaning unit 51C, FIG. 8, is brought to the cleaning position Z, the outlet 21C of the piping 58C is aligned with the rearmost piping 59C, as shown in FIG. 9C. As a result, the C toner conveyed by the conveyor screw 57C is returned to the developing unit 16C, FIG. 1, via the outlet 21C and piping 59C. In this way, the M toner and C toner, like the M toner, can be reused by the associated developing units 16M and 16C, respectively.

As described above, the embodiment can recycle all the toners of different colors and makes it needless for them to be poured into the developing units by hand. Further, the embodiment eliminates the need for waste toner tanks for receiving, or discarding, the collected toners, thereby further saving the space.

The shutter 22Y, 22M or 22C of the cleaning unit which is not located at the cleaning position Z is held in a blocking position. Hence, the toner is prevented from dropping from the cleaning unit, which is out of operation, via the outlet 21Y, 21M or 21C.

In FIG. 7, paddles 30Y, 30M and 30C are respectively disposed in the developing units 16Y, 16M and 16C. While one of the developing units 16Y–16C is in operation, the paddle 30Y, 30M or 30C disposed therein is continuously rotated. In this configuration, while one developing unit 16Y, 16M or 16C is in operation, the corresponding cleaning unit 51Y, 51M or 51C delivers the collected toner to the developing unit. As a result, the paddle 30Y, 30M or 30C in rotation surely mixes and agitates the collected toner and the fresh toner existing in the developing unit 16Y, 16M or 16C.

The pipings and conveyor screws described above constitute the toner delivering means for transporting the toners collected in the respective cleaning units to the developing units storing the toners of corresponding colors. Preferably, coils, screws or similar conveyor means should be disposed in the pipings 59Y–59C in order to insure the delivery of the tones to the developing units.

In FIGS. 9A–9C, the shutters 22Y–22C are respectively positioned at the toner outlets of the pipings 58Y–58C. Alternatively, they may be respectively located at positions where the pipings 59Y–59C are connected to the developing units 16Y–16C. In such a case, too, only one of the shutters 22Y–22C associated with the developing unit in operation will be opened to return the collected toner to the developing unit.

In the illustrative embodiment, the pipings 58Y–58C, FIGS. 9A–9C, each has a particular length and, therefore, lets the associated toner fall at a particular position, as stated previously. Hence, it is not necessary for each toner receiving portion, i.e., piping 59Y, 59M or 59C to be located at a position different from the others. Should the pipings 58Y– 58C have the same length, the pipings 59Y–59C could not be aligned with the respective toner outlets 21Y–21C unless they were shifted in the axial direction of the pipings 58Y–58C (left-and-right direction in FIGS. 9A–9C). Moreover, the embodiment simplifies the toner recycling arrangement since the pipings 58Y–58C do not have to be directly connected to the associated pipings 58Y–59C.

The cleaning device 500, FIG. 8, may be revolved intermittently 120 degrees at a time in response to the output of detecting means for detecting the developing color. This also allows the toner of each color to be surely recycled to the expected developing unit. Specifically, the developing units 16Y–16C, FIG. 7, are provided with developing sleeves 25Y–25C, respectively. While any one of the developing units 16Y–16C is in operation, the developing unit 25Y, 25M or 25C is continuously rotated to convey the associated toner to the developing region between it and the drum 1. In this sense, the color of a toner is represented by the developing sleeve in rotation. The cleaning device 500 is revolved in response to a signal representative of the color, bringing necessary one of the cleaning units 51Y–51C to the cleaning position Z. For example, when the developing unit 16Y is operated, the rotation of the developing sleeve 25Y is detected. Then, the cleaning unit 51Y is brought to the cleaning position Z such that it removes the Y toner left on the drum 1. This is also true with the other cleaning units 51M and 51C. It should be noted that the detecting means responsive to the rotation of the developing sleeve is only illustrative and may be replaced with any other suitable detecting means.

Figure 10A:
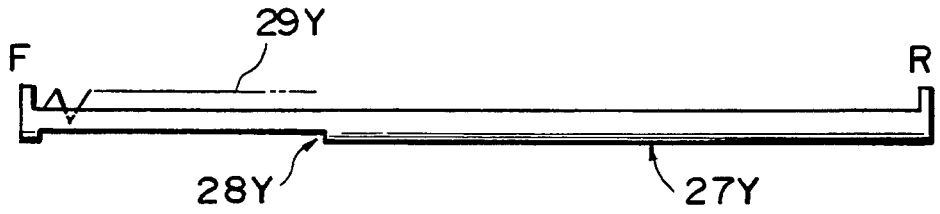
FIGS. 10A–10C are views similar to FIGS. 9A–9C, showing an alternative conduitwork.
Figure 10B:
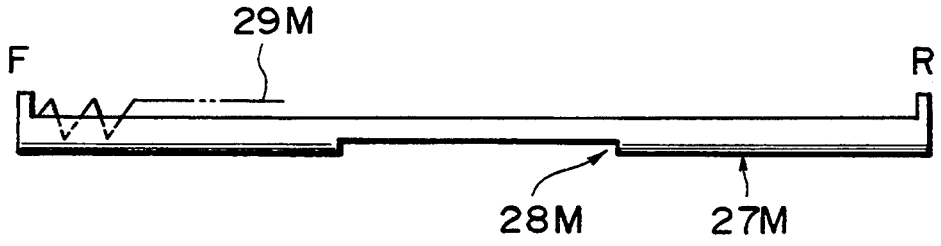
Figure 10C:
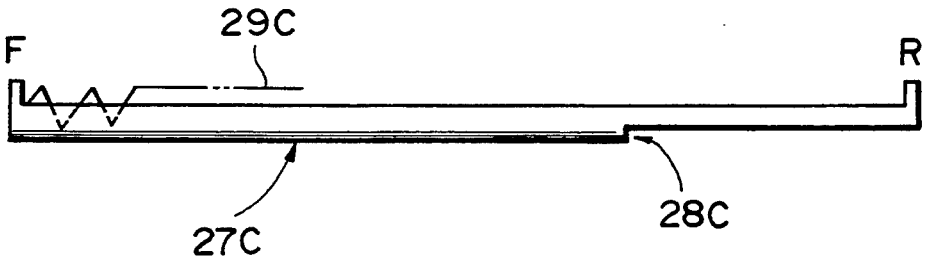

Referring to FIGS. 10A–10C, there are shown an alternative configuration of the pipings 58Y–58C of FIG. 8. As shown in FIG. 10A, a piping 27Y, corresponding to the piping 58Y, is provided with a circular flange at opposite ends thereof and is open at the upper half. In the specific configuration, an opening or toner outlet 28Y is formed in the piping 27Y at a distance, as measured from the front end (F), which is one-third of the entire length of the piping 27Y. A conveying member implemented as a coil 29Y is disposed in the piping 27Y to convey the collected toner to the outlet 28Y. As shown in FIG. 10B, a piping 27M, corresponding to the piping 58M, is formed with a toner outlet 28M at the intermediate one-third range thereof. A coil 29M is received in the piping 27M for delivering the collected toner to the intermediate one-third range. As shown in FIG. 10C, a piping 27C, corresponding to the piping 58C, is formed with a toner outlet 28C in the rear one-third range thereof; a coil 29C is disposed in the piping 27C for conveying the collected toner to the rear one-third range.

Figure 11:
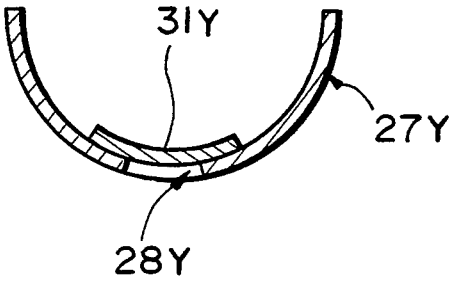
FIG. 11 is a section showing part of the conduitwork of FIGS. 10A–10C where a toner outlet is blocked by a shutter.

As shown in FIG. 11, a shutter 31Y is associated with the piping 27Y for selectively blocking and unblocking the outlet 28Y. Such a shutter is also associated with each of the other pipings 27M and 27C, although not shown in the figures. Further, as shown in FIG. 8, the cleaning device 500 is enclosed by a cover 53 in order to prevent the toners from being scattered around to the outside.

Figure 12:
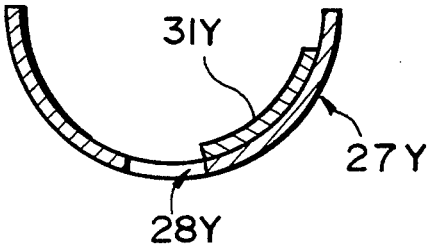
FIG. 12 is a view similar to FIG. 11, showing the outlet unblocked by the shutter.
Figure 13:
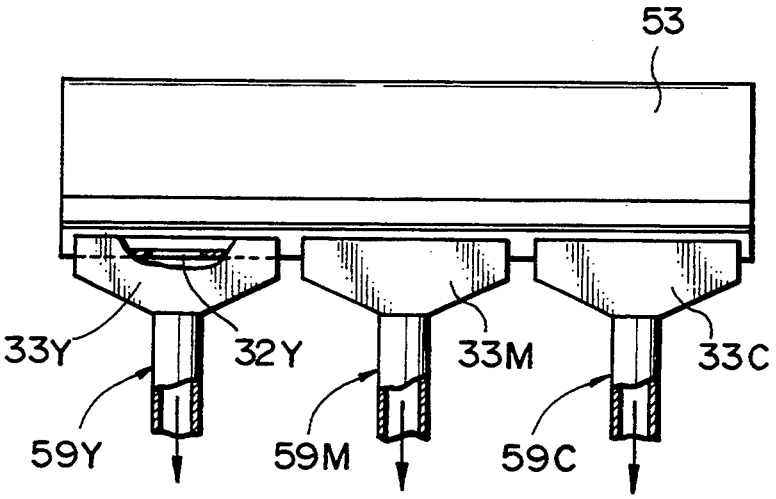
FIG. 13 shows pipings also included in the cleaning device for recycling.

Assume that the cleaning unit 51Y is brought to the cleaning position Z. Then, the outlet 28Y, FIG. 11, is aligned with the piping 59Y, as shown in FIG. 13. At the same time, the shutter 31Y is shifted to the position shown in FIG. 12 by a drive mechanism, not shown, thereby unblocking the outlet 28Y. In this condition, the coil 28Y, FIG. 10A, is rotated to convey the collected Y toner to the front one-third range of the piping 27Y. As a result, the toner is dropped through the outlet 28Y. Further, as shown in FIG. 13, this part of toner is introduced into the piping 59Y via an opening 32Y formed in a cover 31. Likewise, when the cleaning unit 51M is located at the cleaning position Z, the collected M toner is introduced into the piping 59M shown in FIG. 13; when the cleaning unit 51C is located at the cleaning position Z, the collected C toner is introduced into the piping 59C. These Y, M and C toners are returned to the developing units 16Y, 16M and 16C, respectively. As shown in FIG. 13, funnel-shaped portions 33Y, 33M and 33C are formed integrally with the pipings 59Y, 59M and 59C, respectively.

With the alternative arrangement described above, it is also possible to guide the toners collected in the respective cleaning units to the corresponding developing units automatically. The toner delivering means includes the pipings 27Y–27C having the outlets 28Y–28C. The outlets 28Y–28C are each located at a particular position in the axial direction of the drum 1. This is also successful in simplifying the arrangement around the cleaning device 500.

Figure 14A:
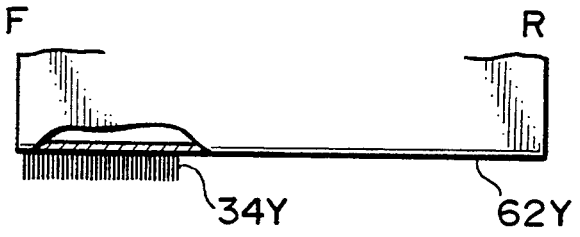
FIGS. 14A–14C each shows a casing included in the cleaning device.
Figure 14B:
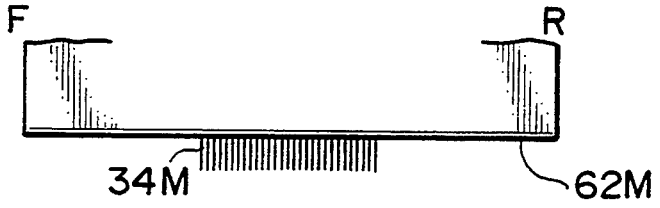
Figure 14C:
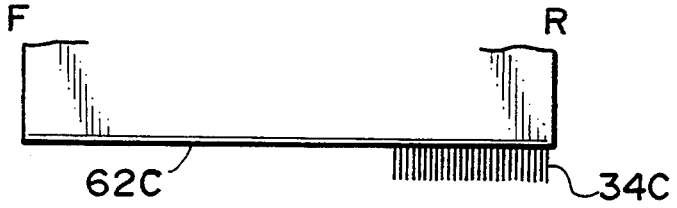

When the pipings 27A–27C shown in FIGS. 10A–10C are used, the toners are apt to deposit and remain in the inner peripheral regions of the cover 53 corresponding to the outlets 28Y–28C, respectively. FIGS. 14A–14C show a specific implementation for obviating such an occurrence. As shown in FIG. 14A, a brush 34Y is provided on the outer periphery of the casing 62Y. FIG. 8, over the front one-third range. Likewise, as shown in FIG. 14B, a brush 34M is provided on the outer periphery of the casing 62M over the intermediate one-third range. Further, as shown in FIG. 14C, a brush 34C is provided on the outer periphery of the casing 62C over the rear one-third range. In this configuration, when the cleaning device 500 revolves 120 degrees at a time, the brushes 34Y–34C each rubs against the corresponding inner peripheral portion of the cover 53, thereby scraping off the toner deposited on the cover 53. This part of toner is introduced into associated one of the pipings 59Y–59C, so that effective color-by-color toner collection is promoted.

Figure 15:
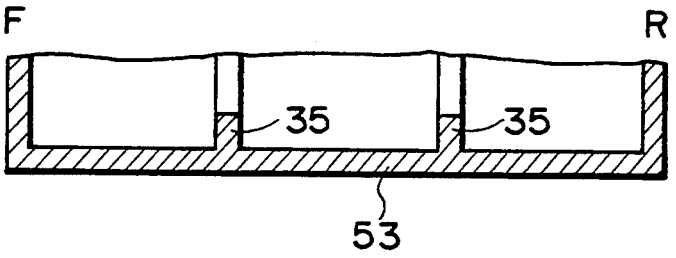
FIG. 15 is a section of a cover also included in the cleaning device.

As shown in FIG. 15, the cover 53 may be provided on the inner periphery thereof flanges 35 which separate the front, intermediate and rear one-third ranges. The flanges 35 will effectively prevent the toners of different colors from being mixed with each other.

Figure 16:
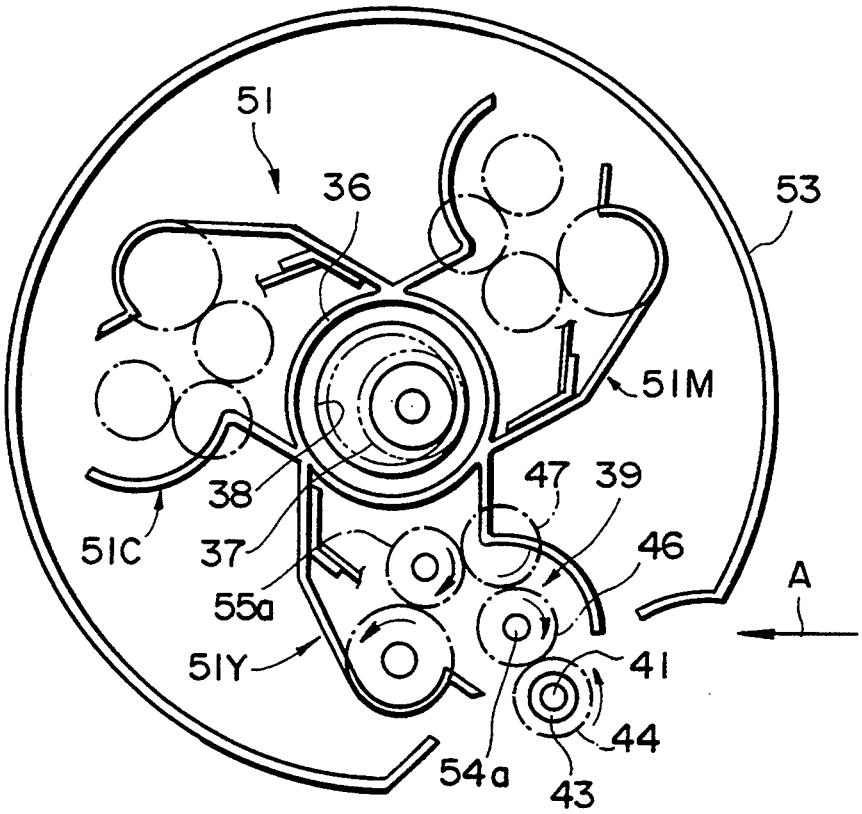
FIG. 16 is a section showing a driveline also included in the cleaning device.

As shown in FIG. 16, the cleaning units 51Y–51C are formed integrally with and around a tubular portion 36. The center of the tubular portion 36 defines the center of rotation of the cleaning device 500. An internal gear 38 is mounted on one end of the tubular portion 36 and held in mesh with a pinion 37. As the pinion 37 is driven by a drive system, not shown, it rotates the internal gear 38 with the result that the cleaning device 500 is rotated intermittently 120 degrees at a time.

Figure 17:
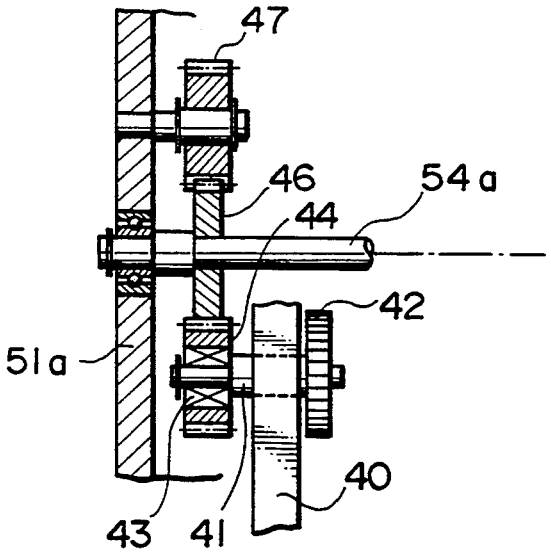
FIG. 17 is a sectional side elevation associated with FIG. 16.

A reference will also be made to FIG. 17 for describing the movements of the fur brushes and bias rollers, taking the fur brush 54Y and bias roller 55Y as an example. FIG. 17 shows a rotation mechanism 39, FIG. 16, in a view as seen in a direction A of FIG. 16. As shown in FIGS. 16 and 17, a shaft 41 is journalled to a sidle wall 40 which is included in the apparatus body and independent of the cleaning device 500. A gear 42 is affixed to the shaft 41. When the gear 42 is driven by the drive system of the apparatus body, it rotates a gear 44 via a one-way clutch 43. The cleaning device 500 includes a side wall **51*a* to which a shaft 54*a*, supporting the fur brush 54Y, is journalled. The gear 44, in turn, rotates a gear 46 which is affixed to the shaft 54*a*. As a result, the fur brush 54Y mounted on the shaft 54*a* is rotated clockwise. The gear 46 is held in mesh with an idle gear 47 as well as with the gear 44. Hence, the rotation of the gear 46 is transmitted to a gear 55*a*, FIG. 16, via the idle gear 47. The gear 55*a*, in turn, rotates the bias roller 55Y, FIG. 8, clockwise. Further, the rotation of the gear 55*a* is transferred to a gear 57*a* which, in turn, drives the conveyor screw 57Y, FIG. 8**.

When the cleaning device 500 is rotated clockwise 120 degrees at a time by the pinion 37, the bear 46 meshes with the gear 44 mounted on the apparatus body. At this instant, the gear 46 tends to cause the gear 44 to rotate clockwise. However, the one-way clutch 43 simply causes the gear 44 to idle counterclockwise, thereby preventing the torque from reaching the shaft 41.

The drive arrangements associated with the other cleaning units 51M and 51C are identical with the drive arrangement described above and will not be described in order to avoid redundancy.

The embodiment shown and described is practicable not only with a photoconductive drum but also with a photoconductive belt or similar image carrier. Further, the embodiment is applicable even to a color image forming apparatus using a revolver type developing device having a plurality of developing units therein. In this way, the embodiment is practicable with a color image forming apparatus having a developing device made up of at least two developing units. The cleaning device is provided with the same number of cleaning units as the developing units. For example, when the developing device shown in FIG. 7 additionally includes a black developing unit, the cleaning device will be provided with four cleaning units in total. Of course, the embodiment described above will be modified in conformity to the number of cleaning units.

Figure 18:
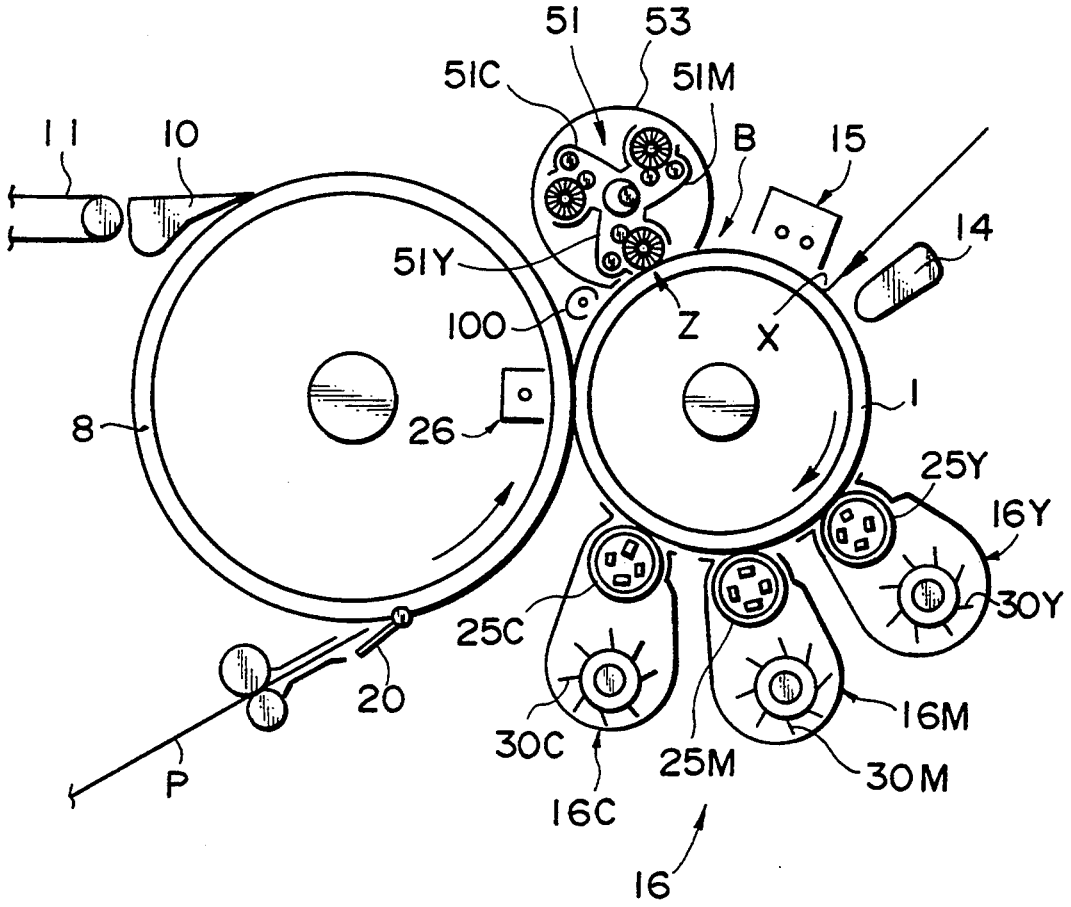
FIG. 18 is a fragmentary section showing an alternative embodiment of the color image forming apparatus in accordance with the present invention.
Figure 19:
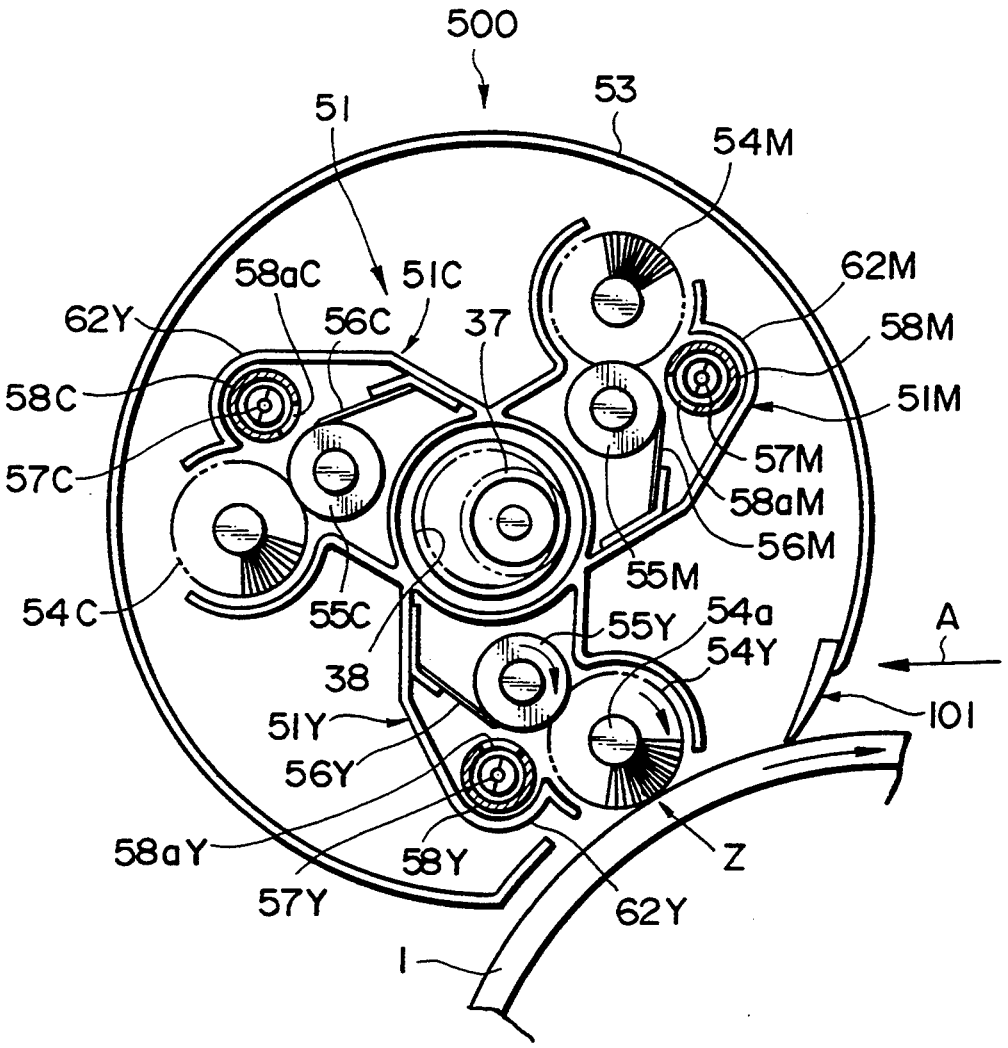
FIG. 19 is a section of a cleaning device included in the embodiment of FIG. 18.

Referring to FIGS. 18 and 19, an alternative embodiment of the color image forming apparatus in accordance with the present invention will be described. This embodiment is essentially similar to the previous embodiment except for the following. As shown in FIG. 18, a precleaning charger (PCC) 100 is positioned upstream of the cleaning device 500 with respect to the direction in which the drum 1 is rotatable. After the transfer of any toner image, the PPC 100 regulates the magnetism of the toner left on the drum 1. Thereafter, the cleaning device 500 removes the toner from the drum 1. As shown in FIG. 19, a member 10 1 is affixed to the downstream edge of the cover 53 with respect to the direction of rotation of the drum 1. The member 101 is implemented by, for example, a Mylar or a blade of urethane rubber. Assume that some toner is still left on the drum 1 having moved away from the cleaning position Z. Then, the member 101 surely prevents such a toner from leaking downstream away from the cleaning device. As a result, the scattering of toners and the mixture of toners of different colors are eliminated. If desired, the member 101 affixed to the downstream edge of the cover 53 may be replaced with cleaning means located downstream of the cleaning device 500 (B, FIG. 18) and using, for example, a blade. In such a case, however, the collected toners have to be simply discarded.

In summary, it will be seen that the present invention has various unprecedented advantages, as enumerated below.

(1) In a color image forming apparatus using toners of two or more different colors, each toner can be collected without being mixed with the others and, therefore, can be reused.

(2) Since cleaning units do not have to be arranged side by side along the periphery of a photoconductive drum, a cleaning device occupying a minimum of space is implemented.

(3) A cleaning unit is replaced with another cleaning unit after it has fully removed a toner from the photoconductive drum. This prevents a toner of one color from being introduced into a cleaning unit storing a toner of another color.

(4) The cleaning device can switch the cleaning unit efficiently by a minimum of movement.

(5) In the event of replacement of the cleaning unit, the portion or the cleaning device facing the drum is directed upward. Hence, the toner in the cleaning unit is prevented from leaking and contaminating the interior of a copier.

(6) In the event of replacement of the cleaning unit, the toner is fully removed from the drum without being left at the portion where the cleaning unit and drum contact each other. This prevents a toner or one color from being introduced into a cleaning unit storing a toner of another color.

(7) Even when a toner flows out of a cleaning unit during the rotation of the cleaning device, it is prevented from being scattered around in the copier.

(8) Toners, moving due to the rotation of the developing device, are prevented from flowing out of the cleaning units into the copier.

(9) Each toner can be collected in a receptacle or recycled to the associated developing unit independently of the others. In addition, the entire image forming apparatus can be further miniaturized, and the free layout of various process units is promoted.

(10) The toner of particular color collected by one cleaning unit can be recycled to associated one of the developing units independently of the other toners and, therefore, reused efficiently. It is not necessary for the operator to pour the toners collected by the cleaning device into the developing device by hand. In addition, waste toner tanks are not needless which would aggravate the space requirement.

(11) The toners of different colors can be surely collected independently of each other.

(12) Portions for receiving toners coming out of respective pipings do not have to be changed in position. This simplifies arrangements around the cleaning device.

(13) During cleaning, the toner is prevented from flowing out of the cleaning device into the image forming apparatus.

(14) Even toners deposited on a cover can be collected efficiently.

(15) The toners removed from the cover are each prevented from being introduced into the developing units storing toners of different colors.

(16) The collected toners can be reused without being mixed since they are surely removed from the photoconductive element.

Various modifications will become possible for those skilled in the art after receiving the teachings of the present disclosure without departing from the scope thereof.

What is claimed is:

1. A cleaning device for a color image forming apparatus having image forming means of the type forming a toner image on an image carrier by using toners of at least two colors, said device comprising:

a plurality of cleaning units each being assigned to the respective toner to be deposited on the image carrier; and recycling means for recycling the toners removed from the image carrier by the respective cleaning units.

2. A device as claimed in claim 1, further comprising switching means on which said cleaning units are arranged such that said cleaning units are bodily revolvable relative to the image carrier to thereby replace each other.

3. A device as claimed in claim 2, further comprising unit revolving means and unit control means for causing, in the event of replacement of any one of said cleaning units, said cleaning units to bodily revolve at least after the toner has been collected from the image carrier.

4. A device as claimed in claim 1, wherein said cleaning units are sequentially arranged in order of color for image formation.

5. A device as claimed in claim 1, wherein in the event of replacement of any one of said cleaning units, said cleaning unit has a portion thereof facing the image carrier directed upward.

6. A device as claimed in claim 1, further comprising a toner collecting member for preventing, in the event of replacement of any one of the cleaning units, the toner from remaining in a portion of the image carrier which contacts said cleaning unit.

7. A device as claimed in claim 6, further comprising voltage applying means for applying, in the event of replacement of any one of said cleaning units, a voltage to said toner collecting member of said cleaning unit.

8. A device as claimed in claim 6, wherein said toner collecting means comprises a fur brush disposed in each of said cleaning units.

9. A device as claimed in claim 8, further comprising rotating means for causing, in the event of replacement of any one of said cleaning units, said fur brush of said cleaning unit to rotate.

10. A device as claimed in claim 1, further comprising a body, and a member located outside of said body and covering all said cleaning units to prevent the toners from being scattered around.

11. A device as claimed in claim 1, further comprising checking means disposed in each of said cleaning units for preventing the collected toner from flowing backward.

12. A color image forming apparatus comprising:

an image carrier;

a developing device comprising a plurality of developing units each of which develops a latent image formed on said image carrier with a toner of particular color to thereby produce a corresponding toner image;

transferring means for transferring the toner image to a recording medium; and a cleaning device for cleaning the toner remaining on said image carrier after image transfer;

said cleaning device comprising a plurality of cleaning units adjoining each other in a circumferential direction;

said plurality of cleaning units being each assigned to the toner of particular color:

said cleaning device being revolvable such that in the event of cleaning, said plurality of cleaning units are selectively brought to a predetermined cleaning position.

13. An apparatus as claimed in claim 12, further comprising toner delivering means for delivering each of the toners collected in the respective cleaning units to one of the developing units storing a toner of the same color as the collected toner.

14. An apparatus as claimed in claim 13, wherein said cleaning device revolves on the basis of a color for development detected.

15. An apparatus as claimed in claim 14, wherein said toner delivering means comprises pipings respectively associated with said cleaning units, said pipings each having a toner outlet at a particular position in an axial direction of said image carrier.

16. An apparatus as claimed in claim 12, further comprising a cover surrounding said cleaning device for preventing the toners from being scattered around.

17. An apparatus as claimed in claim 16, further comprising a brush affixed to each of said cleaning units for scraping off the toner deposited on an inner periphery of said cover.

18. An apparatus as claimed in claim 17, wherein said cover comprises flanges on an inner periphery thereof for preventing the toners of different colors from being mixed with each other.

19. An apparatus as claimed in claim 16, further comprising means located down stream of said cover for preventing the toners from leaking.

* * * * *